US006227241B1

(12) United States Patent
Snel et al.

(10) Patent No.: US 6,227,241 B1
(45) Date of Patent: May 8, 2001

(54) ACTUATOR VALVE FOR PRESSURE SWITCH FOR A FLUIDIC SYSTEM

(75) Inventors: Fred Snel, Stolwijk; Stefan Beekhuis, Gouda, both of (NL); Wolf Joerg, Sharon, MA (US)

(73) Assignee: Flexcon Industries, Randolph, MA (US)

( * ) Notice: Subject to any disclaimer, the term of this patent is extended or adjusted under 35 U.S.C. 154(b) by 0 days.

(21) Appl. No.: 09/382,869

(22) Filed: Aug. 25, 1999

Related U.S. Application Data

(63) Continuation-in-part of application No. 09/090,723, filed on Jun. 4, 1998, now Pat. No. 5,947,690.

(60) Provisional application No. 60/049,234, filed on Jun. 9, 1997.

(51) Int. Cl.[7] ..... F04B 49/00

(52) U.S. Cl. ..... 137/560; 417/38

(58) Field of Search ..... 137/560; 417/38

(56) References Cited

U.S. PATENT DOCUMENTS

| | | | | |
|---|---|---|---|---|
| 3,493,001 | | 2/1970 | Bevandich | 137/14 |
| 3,560,706 | | 2/1971 | Fonecca | 219/301 |
| 3,739,810 | | 6/1973 | Horan, Jr. | 137/568 |
| 3,782,858 | | 1/1974 | Deters | 417/26 |
| 3,871,792 | * | 3/1975 | Gritz | 417/38 |
| 3,876,336 | | 4/1975 | Nash | 417/38 |
| 3,922,111 | | 11/1975 | Deters | 417/26 |
| 3,973,877 | | 8/1976 | Taki | 417/38 |
| 4,124,332 | | 11/1978 | Nishijyo | 417/26 |
| 4,247,260 | | 1/1981 | Schonwald et al. | 417/38 |
| 4,281,968 | | 8/1981 | Aakers | 417/2 |
| 4,329,120 | | 5/1982 | Walters | 417/12 |
| 4,659,291 | | 4/1987 | Valdes | 417/44 |
| 5,099,544 | | 3/1992 | Yamamoto | 15/339 |
| 5,190,443 | * | 3/1993 | Valdes | 417/38 |
| 5,197,859 | | 3/1993 | Siff | 417/19 |
| 5,509,787 | * | 4/1996 | Valdes | 417/38 |
| 5,947,690 | | 9/1999 | Snel et al. | 417/38 |

FOREIGN PATENT DOCUMENTS

| | | |
|---|---|---|
| 83 15 687 | 7/1985 | (DE) . |
| 0 004 056 | 9/1979 | (EP) . |
| 0 459 434 | 12/1991 | (EP) . |
| 0 539 721 | 5/1993 | (EP) . |
| 1313115 | 11/1962 | (FR) . |
| 2226514 | 11/1974 | (FR) . |
| 2 173 344 | 10/1986 | (GB) . |
| 2 198 883 | 6/1988 | (GB) . |

* cited by examiner

*Primary Examiner*—A. Michael Chambers
(74) *Attorney, Agent, or Firm*—Choate, Hall & Stewart; Valarie B. Rosen

(57) ABSTRACT

Hydraulic actuator. An actuator body includes an inlet, an outlet, a port communicating with a pre-charged diaphragm tank, and a port communicating with a pressure switch. The actuator body includes a movable member which, in a first position, closes the inlet port and provides fluidic communication with the pressure switch port while allowing pressure equalization between the inlet and an interior of the actuator body. In a second position, the movable body opens the inlet port and seals the pressure switch port. A spring is disposed within the actuator body to urge the movable member toward the first position. The invention eliminates the need for multiple springs as shown in one prior art design and eliminates the need for reliance on a hydrostatic force differential to move the movable member.

14 Claims, 5 Drawing Sheets

ACTUATOR VALVE FOR PRESSURE SWITCH FOR A FLUIDIC SYSTEM

This application is a continuation-in-part of U.S. patent application Ser. No. 09/090,723, filed Jun. 4, 1998, now U.S. Pat. No. 5,947,690 issued Sep. 7, 1999, which application is incorporated herein by reference, and also claims priority to U.S. Provisional Application No. 60/049,234, filed Jun. 9, 1997, the entire contents of which are incorporated herein by reference.

BACKGROUND OF THE INVENTION

Electrically operated pumps are used to supply water from wells and to boost the pressure of municipal water systems. Such pumps are operated by electric motors under the control of a pressure sensitive switch. Some prior art systems operate by keeping a reservoir tank substantially filled with water. In such a system, the pump motor turns on when pressure drops below a pre-set value and turns off when the pressure reaches another higher pre-set value. The duty cycle for the electric motor in such a system is high with numerous transitions from off to on and off again.

Alternative systems are known in which the pump runs when there is a demand for water and is off when the demand ceases. U.S. Pat. Nos. 5,190,443 and 5,509,787 are directed to actuators which control a pump based on demand. In these two patents, the interplay of hydrostatic and hydrodynamic forces moves a shuttle member which alternately opens and closes a passageway to allow pressure to communicate with a pressure-activated switch for controlling the pump motor. Another design as set forth in U.S. Pat. No. 3,871,792 utilizes a combination of hydrodynamic forces and spring forces to control a switch operate the pump motor. In particular, the configuration set forth in the '792 patent requires two springs, one to control the moving member of a poppet valve and another spring to control the motion of a flexible diaphragm. The design is also complicated by first and second internal auxiliary passageways to provide for pump motor control.

SUMMARY OF THE INVENTION

In one aspect, the invention is a hydraulic actuator comprising an actuator body which includes an inlet, at least one outlet, a port communicating with a pre-charged diaphragm tank, and a port communicating with a pressure switch. The actuator body includes a movable member which, in a first position, fills the inlet port and provides fluidic communications with the pressure switch. In a second position, the movable member opens the inlet's port and seals the pressure switch port. The actuator further comprises a spring disposed within the actuator body, which urges the movable member towards the first position. The movable member includes a bypass which provides fluidic communication between the inlet and interior of the actuator body when the movable member is in the first position.

In another aspect, the invention is a hydraulic actuator comprising an actuator body which includes an inlet, at least one outlet, a port communicating with a precharged diaphragm tank, a port communicating with a pressure switch, and a passageway communicating with the port which communicates with the pressure switch and an interior of the actuator body. The actuator body includes a movable member which seals the inlet port and provides fluidic communication with the pressure switch when it is in a first position. In a second position, the movable member opens the inlet port and seals the pressure switch port. The actuator further comprises a spring disposed within the actuator body which urges the movable member toward the first position. The movable member includes a bypass which provides fluidic communication between the inlet and an interior of the actuator body which the movable member is in the first position. The actuator may further include a support member which includes a transverse passageway in fluidic communication with an axial passageway, wherein the axial passageway communicates with the port which communicates with the pressure switch. The support member may include plurality of spaced apart seals. The movable member may include a passageway which enables fluidic communication between the interior of the actuator body and the port in communication with the pressure switch when the movable member is in the first position.

The bypass may comprise at least one groove oriented longitudinally with respect to the movable member, which is cut into a surface of the movable member, or the by-pass may comprise at least one channel drilled through a base portion of the movable member. The movable member may include a passageway which enables fluid communication between the port which communicates with the pressure switch and the interior of the actuator body when the movable member is in the first position. When the movable member is in the first position, it may be seated in a recess in the actuator body and may seal the inlet port by means of an o-ring seated in the recess. The pressure switch may have a cut-out pressure setting corresponding to a flow rate of 1 gal/min or less. The actuator may further include a support member which guides the movable member in a sliding motion. The support member may include a transverse passageway which is in fluidic communication with an axial passageway, which in turn communicates with the port communicating with the pressure switch. The movable member may include a passageway which enable fluidic communication between the transverse passageway and the interior of the actuator body when the movable member is in the first position.

DESCRIPTION OF THE PREFERRED EMBODIMENT

Figure 1:
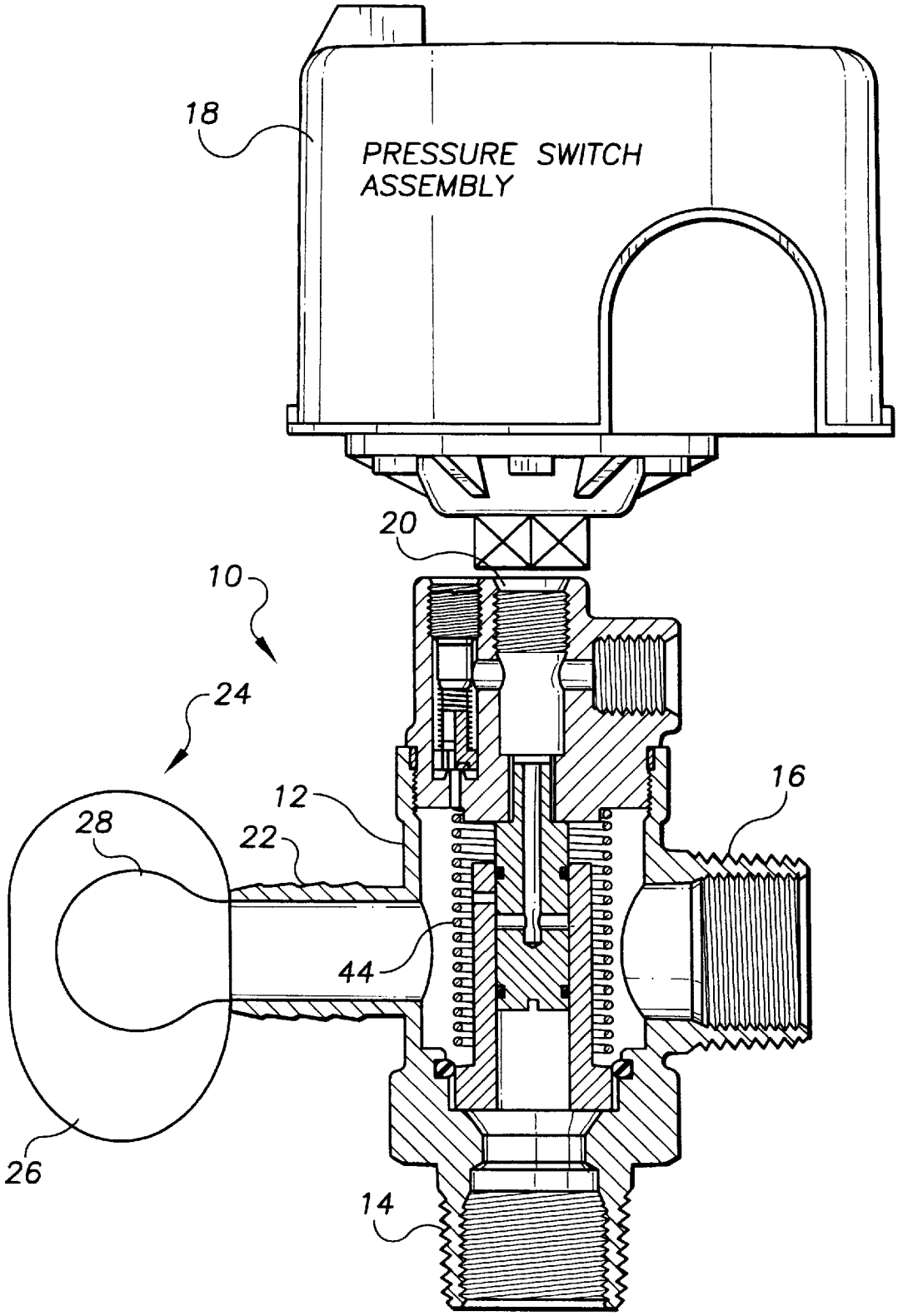
FIG. 1 is a cross-sectional view, partly exploded, of the actuator valve of the invention along with a pressure switch.

With reference first to FIG. 1, an actuator system 10 includes an actuator body portion 12. The body portion 12 includes an inlet connection portion 14 which is adapted to be connected to a pump (not shown). As will be appreciated by those skilled in the art, the pump is connected to a source of water such as a well or a municipal water supply. The actuator body 12 also includes an outlet port 16 from which water is discharged as, for example, through a faucet (not shown). There may be additional outlet ports. A pressure switch assembly 18 includes an electrical switch which, when closed, turns on a pump and which, when opened, turns off a pump. The pressure switch assembly 18 is connected to a port 20 which communicates with the pressure switch 18. A port 22 is connected to a pre-charged diaphragm tank assembly 24. The tank assembly 24 includes an outer enclosure 26 and an inner diaphragm 28. Water fills the diaphragm 28 which expands against air entrapped between the diaphragm 28 and the enclosure 26 to pressurize the water.

The actuator assembly 10 will now be described in more detail in conjunction with FIG. 2. Disposed within the actuator body 12 is a movable member 30 which is guided in its sliding motion by a fixed support 33. As shown in the figure, the movable member 30 seats within a recess portion 32 and is in sealing relation by virtue of an o-ring seal 34. Where the movable member number 30 is seated in recessed portion 32, the base of the moveable member is tapered. The angle, n, of the taper may be 15°, and the distance x over which the taper extends may be 0.015 in. The support member 33 includes spaced apart o-ring seals 36 and 38. The fixed support 33 includes a transverse passageway 40 which is in fluid communication with an axial passageway 42. The axial passageway 42 communicates with the port 20 leading to the pressure switch 18 (FIG. 1).

The operation of the actuator 10 of the invention will now be described in conjunction with FIGS. 2A–C. When the movable member 30 is fully seated within the recess 32, the inlet port 14 is closed while the port 40 is in fluidic communication with fluid within the actuator body 12 via passageway 41. Thus, the pressure switch 18 responds to pressure within the actuator body 12 through the passageways 40 and 42. The diaphragm 28 is distended by being filled with water; pressure is provided by air compressed between the diaphragm 28 and the enclosure 26. A low flow bypass 62 in movable member 30 enables pressure equalization between the fluids in the actuator body 12 and the inlet connection 14. FIG. 3B depicts bypass 62 as two longitudinal grooves in movable member 30. The bypass may also only comprise one groove or may comprise a channel or hole which is cut through the base or bottom of movable member 30. The bypass may also comprise a combination of channels and grooves, depending on the desired pressure within the actuator body 12. Because o-ring 34 is seated in recess 32, when the movable member 30 is seated within the recess, the inlet port 14 is not completely sealed from the interior of actuator 12 but rather enjoys a finite amount of fluidic communication with the interior of the actuator 12 via the bypass 62.

When a faucet is opened, water will be discharged from the pre-charged diaphragm tank 24 through the outlet port 16. For example, the pre-charged tank may exhibit a pressure of approximately 50 psi. As water flows through the outlet port 16, pressure will decrease as the diaphragm 28 decreases in volume. The pressure decrease will be communicated through the unsealed passageway 40 to the pressure switch 18. The pressure switch 18, as will be appreciated by those skilled in the art, is adjusted to have a cut-in pressure setting, for example, 30 psi, below which the switch activates a pump motor and a cut-out pressure setting which deactivates the pump motor. Thus, when the pressure falls the pump motor will be activated, causing fluid to flow through the inlet port 14. Pressure generated by the pump will cause the movable member 30 to move out of the recess 32 by overcoming the force of a spring 44 which urges the movable member downwardly. Under the influence of the pump, the movable member 30 moves upwardly as shown in FIGS. 2B and 2C. The spring 44 is not shown in FIGS. 2A–C for clarity. Hydrodynamic forces arising from the flow of water through the inlet port 14 keeps the movable member in the upward position against the force of the spring 44. Thus, water continues to flow through the output port 16. Of course, the cross-sectional area of the grooves and channels contributing to bypass 62 will reduce the force inserted on the movable member 30 by a given flow rate of water. It is important to note that when the movable member 30 is in its upward position as shown in FIG. 2C, the transverse passageway 41 is above the o-ring seal 38 so that the passageway 40 is now sealed off from, and cannot respond to, fluid pressure changes in the actuator body 12. Therefore, the pump will remain running as long as fluid is flowing through the outlet 16. When, however, a faucet is turned off, flow through the outlet port 16 will stop. For a while, flow will continue through the port 22 into the diaphragm 28. As the flow slows, the pressure in the tank will gradually increase so that the hydrodynamic force holding the movable member 30 open will be less than the downward force exerted by spring 44. The movable member 30 will then reverse its path along fixed support 33, moving downwardly as shown in FIG. 2B and finally all the way downwardly into its resting position in the recess 32 as shown in FIG. 2A. When the member 30 is in the downward position shown in FIG. 2A, the passageway 41 is now beneath the o-ring seal 38 and in fluidic communication with the fluid within the actuator body 12 via port 40 so that the passageway 40 is unsealed and "feels" the pressure in the body 12. This high pressure is communicated to the pressure switch 18 which shuts off the pump motor. For example, a flow rate of 1 gal/min is enough to hold up the moveable member 30 against the force of spring 44, but if the flow rate decreases to ¾ gal/min, the force will not be sufficient, and the pump will shut off. When a faucet is once again opened, the process just described is repeated with an activation of the pump motor for as long is fluid is flowing through the outlet 16 and a deactivation of the motor once fluid flow ceases.

However, the consumer may not always turn on a faucet to its maximum flow. There are many situations in which full flow is not necessary and lower flow is preferred. In case a faucet is not completely opened, it will take longer for the diaphragm 28 to empty, the pressure in the interior of the actuator body 12 to decrease, and the pressure switch to open. However, the total flow through the actuator body will not be very high. If the flow rate is low enough, the water may not exert enough pressure on moveable member 30 to move it all the way up to the top of support 33. FIG. 2B shows the moveable member 30 partially elevated in accordance with this example. Despite the low flow, passageway 41 is above o-ring 38, sealing passageway 40 between o-rings 38 and 36 and preventing fluidic communication of the pressure switch with the interior of the actuator body 12. The bypass 62 in movable member 30 enables increased flow from inlet connection 14 to outlet 16 even though the piston is not completely elevated. Thus, the pump is able to operate, and the pressure switch will not cut off, at flows of 1 gal/min or more. When the faucet is turned off and water is no longer being used, water flows slowly from inlet 14 through the bypass 62 into the interior of actuator body 12 until the pressure exerted by the diaphragm 28 and the water flowing through inlet 14 is the same, further slowing the flow rate. At this point, as in the full flow example, movable member 30 will again move downwardly and be seated in recess 32. Passageway 40 will be in fluid communication with the interior of actuator body 12 via passageway 41 and will be able to communicate that pressure to the pressure switch via passageway 42. The pressure switch will thus cut out.

For applications where the consumer desires even lower flow, on the order of ½ gal/min, water will flow out of the diaphragm, and the pump will not come on until a significant amount of water has been drawn by the consumer. At this point, the pump will come on, not so much to further provide water to the consumer as to repressuring the diaphragm.

Figure 2A:
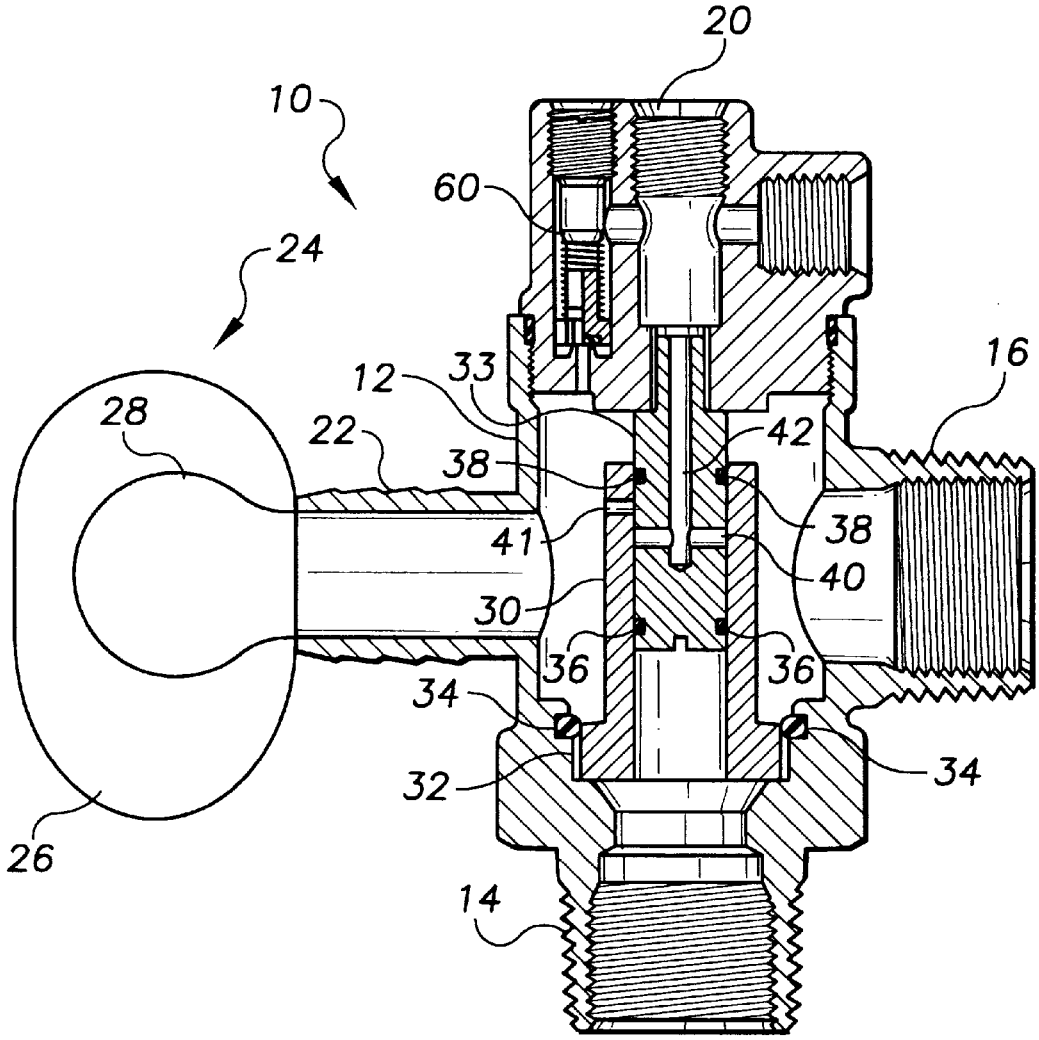
FIGS. 2A, 2B, and 2C are cross-sectional views of the actuator valve in different states of operation.
Figure 2B:
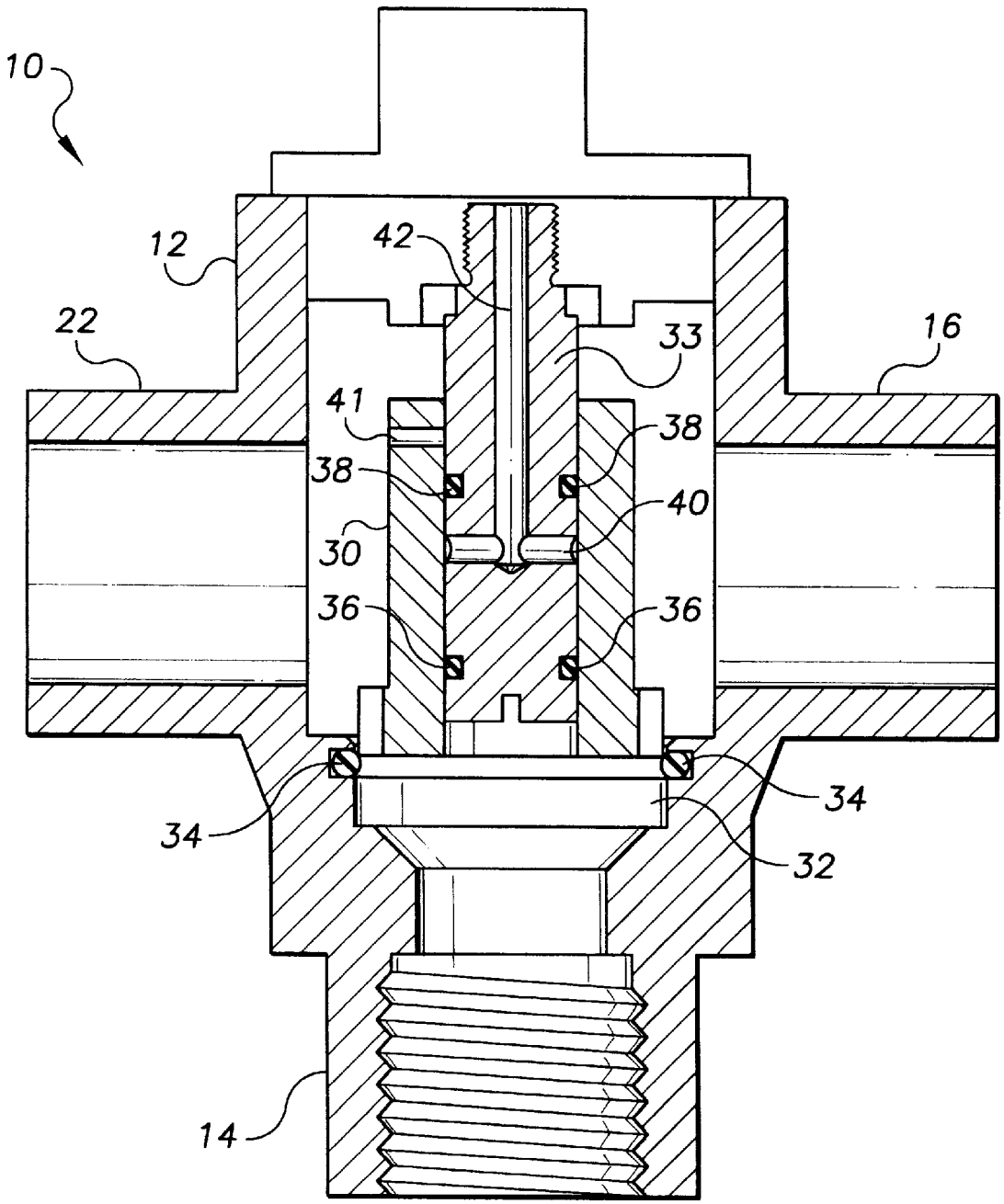
Figure 2C:
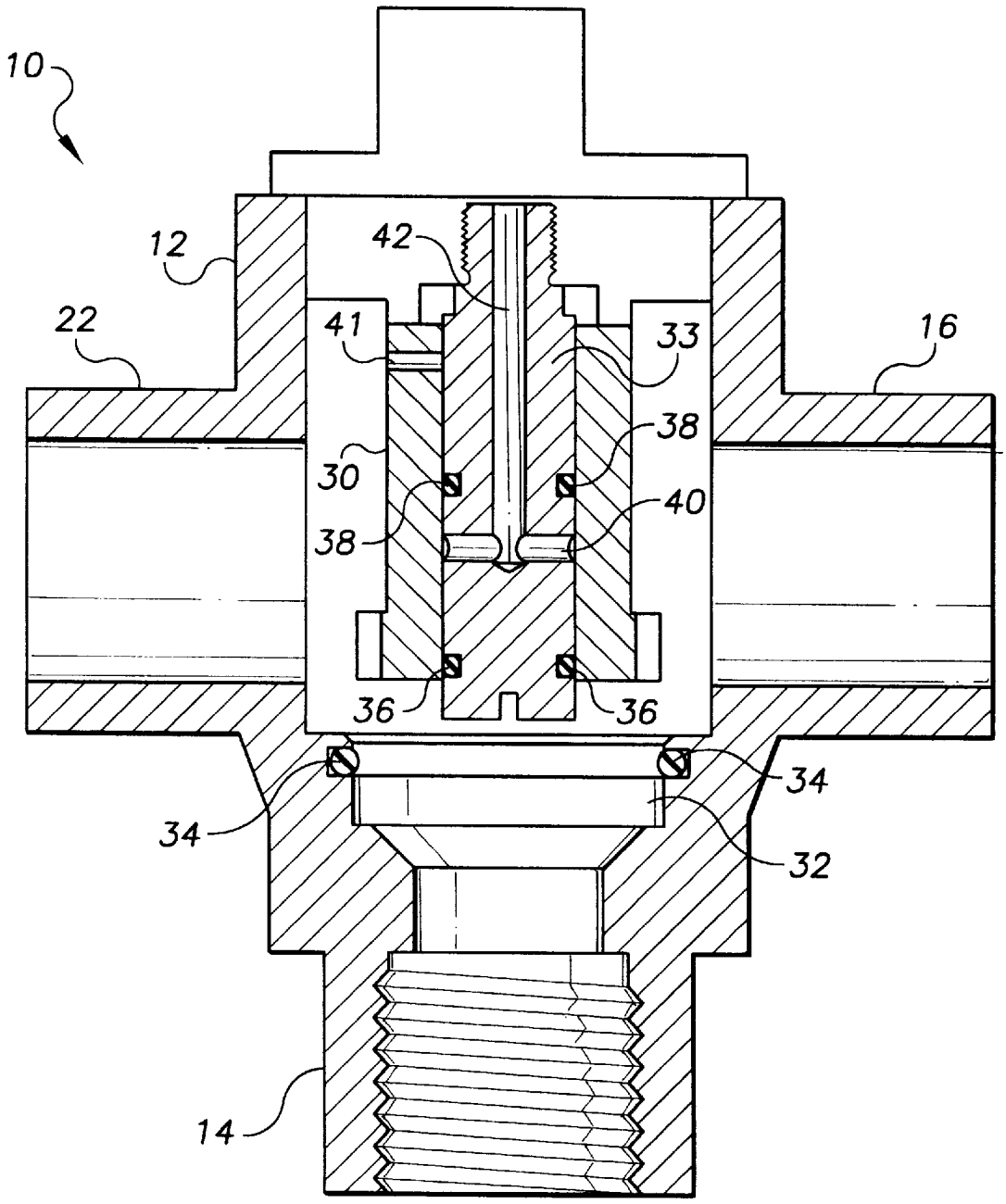
Figure 3A:
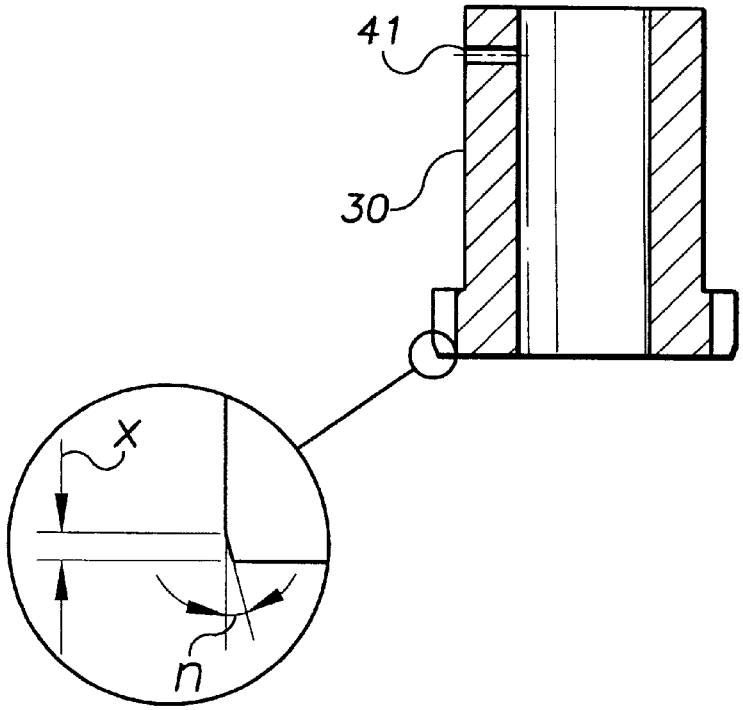
FIG. 3A is a cross-sectional view of the moveable member of the actuator valve.
Figure 3B:
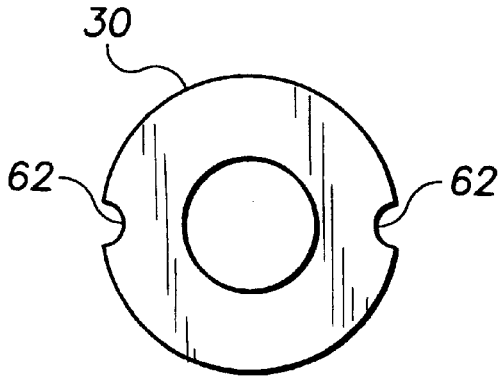
FIG. 3B is an end-on view of the moveable member of the actuator, showing the low-flow bypass.

Also shown in FIG. 2A is an optional relief valve assembly 60. The relief valve 60 is a poppet-type valve which may be set to open at a pre-selected, high pressure. When the valve 60 opens, the high pressure fluid communicates with the pressure switch 18, assuring that it cuts off.

Those skilled in the art will appreciate that the embodiments disclosed herein may be made of any suitable materials such as metals or plastics or a combination thereof. The embodiments disclosed herein have several advantages over prior art designs based on hydrostatic/hydrodynamic principles. In U.S. Pat. No. 5,509,787 discussed above, the area on one side of the movable member had to be smaller than that on the other side so that hydrostatic forces would re-seat the movable member. In the present invention, the areas may be equal since a spring is used to re-seat the movable member 30. Importantly, only the single spring 44 is required to provide pressure switch control, unlike the dual spring design in U.S. Pat. No. 3,871,792. In the present invention, the spring 44 need only overcome the sliding friction of the movable member 30 over the fixed support 33 and no other spring is required.

It is intended that all modifications and variations of the present invention be included with the scope of the appended claims.

What is claimed is:

1. Hydraulic actuator comprising:

an actuator body including an inlet, at least one outlet, a port communicating with a pre-charged diaphragm tank, and a port communicating with a pressure switch;

the actuator body including a movable member which, in a first position, closes the inlet port and provides fluidic communication with the pressure switch; and in a second position, opens the inlet port and seals the pressure switch port; and a spring disposed within the actuator body urging the movable member toward the first position, wherein the moveable member includes a bypass providing fluidic communication between the inlet and an interior of the actuator body when the movable member is in the first position.

2. The hydraulic actuator of claim 1, wherein the bypass comprises at least one groove oriented longitudinally with respect to the moveable member and cut into a surface of the moveable member.

3. The hydraulic actuator of claim 1, wherein the bypass comprises at least one channel drilled through a base portion of the moveable member.

4. The hydraulic actuator of claim 1, wherein the moveable member includes a passageway which enables fluid communication between the port communicating with the pressure switch and the interior of the actuator body when the moveable member is in the first position.

5. The hydraulic actuator of claim 1, wherein, in the first position, the moveable member is seated in a recess in the actuator body and partially seals the inlet port by means of an o-ring seated in the recess.

6. The hydraulic actuator of claim 1, wherein the pressure switch has a cut-out pressure setting corresponding to a flow rate at most 1 gal/min.

7. The hydraulic actuator of claim 1, further including a support member which guides the movable member in a sliding motion, wherein the support member includes a transverse passageway which is in fluid communication with an axial passageway, and the axial passageway communicates with the port communicating with the pressure switch.

8. The hydraulic actuator of claim 7, wherein the moveable member includes a passageway which enables fluid communication between the transverse passageway and the interior of the actuator body when the moveable member is in the first position.

9. Hydraulic actuator comprising:

an actuator body including an inlet, at least one outlet, a port communicating with a pre-charged diaphragm tank, a port communicating with a pressure switch, and a passageway communicating with the port communicating with the pressure switch and with an interior of the actuator body;

the actuator body including a movable member which, in a first position, closes the inlet port and provides fluidic communication with the pressure switch; and in a second position, opens the inlet port and seals the pressure switch port; and a spring disposed within the actuator body urging the movable member toward the first position, wherein the moveable member includes a bypass providing fluidic communication between the inlet and an interior of the actuator body when the movable member is in the first position.

10. The hydraulic actuator of claim 9 further including a support member which guides the movable member in a sliding motion, wherein the support member includes a transverse passageway which is in fluid communication with an axial passageway, and the axial passageway communicates with the port communicating with the pressure switch.

11. The hydraulic actuator of claim 10, wherein the moveable member includes a passageway which enables fluid communication between the transverse passageway and the interior of the actuator body when the moveable member is in the first position.

12. The hydraulic actuator of claim 10, wherein the support member includes a plurality of spaced apart seals.

13. The hydraulic actuator of claim 12, wherein the moveable member includes a passageway which enables fluid communication between the interior of the actuator body and the port in communication with the pressure switch when the moveable member is in the first position.

14. Hydraulic Actuator comprising:

an actuator body including an inlet, at least one outlet, a port communicating with a pre-charged diaphragm tank, and a port communicating with a pressure switch;

the actuator body including a movable member which, in a first position, closes the inlet's port and provides fluidic communication with the pressure switch; and in a second position, opens the inlet port and seals the pressure switch port;

a spring disposed within the actuator body urging the movable member toward the first position, wherein the movable member includes a bypass providing a fluidic communication between the inlet and an interior of the actuator body when the movable member is in the first position; and a support member which guides the movable member in a sliding motion, wherein the support member includes a transverse passageway which is in fluidic communication with an axial passageway and the axial passageway communicates with the port communicating with the pressure switch.

* * * * *